US005372404A

United States Patent [19]

Bratell et al.

[11] Patent Number: 5,372,404

[45] Date of Patent: Dec. 13, 1994

[54] SETTING DEVICE FOR A TILTABLE ARMCHAIR

[76] Inventors: Roger Bratell, Förtroligheten 54, S-412 70 Göteborg; Ingemar Persson, Vårflodsgatan 31, S-417 12 Göteborg, both of Sweden

[21] Appl. No.: 985,878

[22] Filed: Dec. 4, 1992

[51] Int. Cl.[5] ..... A47C 1/02

[52] U.S. Cl. ..... 297/338; 297/325; 297/330

[58] Field of Search ..... 297/323, 330, 337, 338, 297/DIG. 10, 345, 325

[56] References Cited

U.S. PATENT DOCUMENTS

| | | | |
|---|---|---|---|
| 3,479,086 | 11/1969 | Sheridan | 297/330 |
| 3,641,995 | 2/1972 | Brandt | 297/330 X |
| 4,581,778 | 4/1986 | Pontoppidan | 4/251 |
| 4,637,654 | 1/1987 | Boardman | 297/337 |
| 4,838,612 | 6/1989 | Cross | 297/338 |
| 4,946,222 | 8/1990 | Matson | 297/DIG. 10 |
| 4,993,777 | 2/1991 | LaPointe | 297/330 X |

*Primary Examiner*—Rodney M. Lindsey

*Attorney, Agent, or Firm*—Klarquist, Sparkman, Campbell, Leigh & Whinston

[57] ABSTRACT

Adjustment device for tiltable sitting furniture with a stand (1) and a seat board (9) pivoting at the front side of the stand, as well as a driving device (16) arranged to convey the seat board (9) its tilt motion, where the seat board (9) at the front is pivotally arranged at the front edge of a fork (7) articulatedly suspended via arms (5) at the front part of the stand, which fork is in rear the part of the stand and at the rear is guided slidably against a slide rail (10), and the driving device (16) of which via a pressure arm (12) pivotally arranged at the stand transfers motion to the seat board, in addition to the pressure arm (12) is pivotally connected a control bar (19) between its pivot point and its end with the seat board, which control bar during work of the driving device (16) with its front part first is brought to bearing on a position adjustable backing roller (21) connected to the arms (5) of the fork (7) and subsequently with its rear part (23) in different positions adjustable against a rear cross bar (4b) acting as counter surface, whereupon the movement surpasses to a pure tilt about the pivot axis (8) of the seat board. (FIG. 2)

7 Claims, 3 Drawing Sheets

SETTING DEVICE FOR A TILTABLE ARMCHAIR

BACKGROUND OF THE INVENTION

The present invention refers to an adjustment device for a tiltable armchair or a similar sitting furniture.

Disabled persons often have great difficulty in sitting down and getting up from chair seats if they can't get assistance or support from another person. It is evident that assistance is not always available when the disabled person wishes to get up from a sitting position or to get seated from a standing position.

To assist disabled persons in sitting down and getting up from a chair seat, mechanisms have heretofore been developed to enable a rear part of the chair seat to tilt upwardly. Such previously known designs have been cumbersome and complex and have furthermore lacked adjusting possibilities for giving a natural and adapted movement pattern according to an individual's height and other handicap dependent needs.

OBJECT AND MOST ESSENTIAL FEATURES OF THE INVENTION

The object of the present invention is to provide a chair stand for effecting tilting of the a chair seat to facilitate the ability of a handicapped person to sit in a chair and to arise from the chair.

SPECIFICATIONS OF DRAWINGS

The invention will be described in the following in closer detail with reference to an embodiment illustrated in the enclosed drawings, whereby the drawings only show the chair stand with the seat board and its adjustment means connected thereto.

SPECIFICATION OF THE PREFERRED EMBODIMENT

Figure 1:
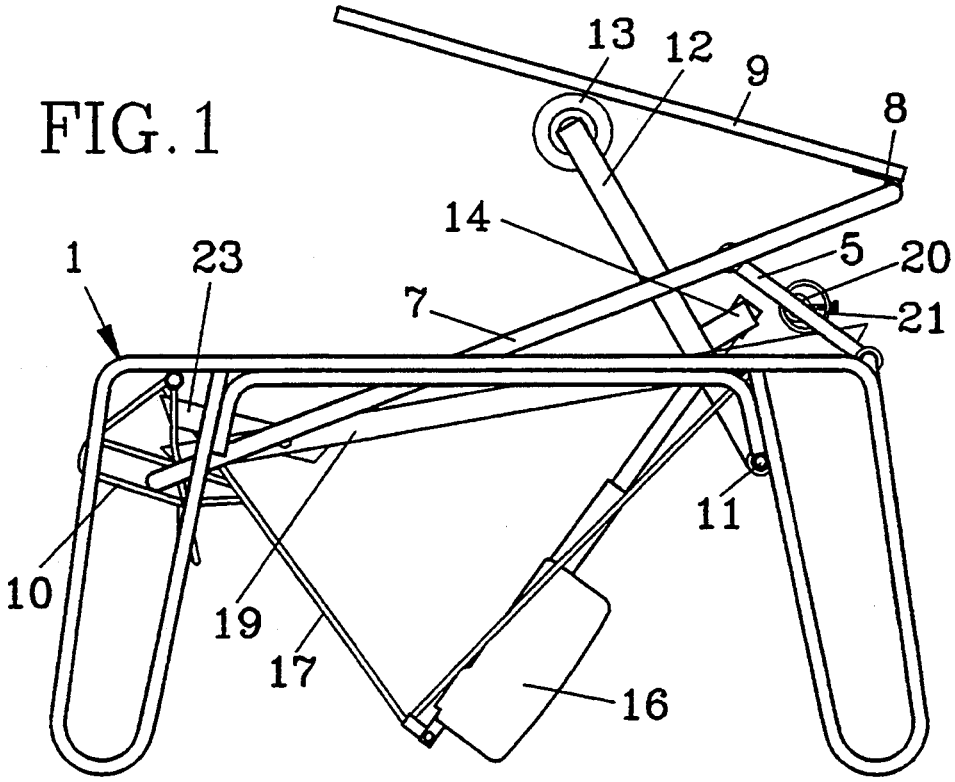
FIG. 1 is a side view of a chair stand of the present invention in a collapsed position.
Figure 2:
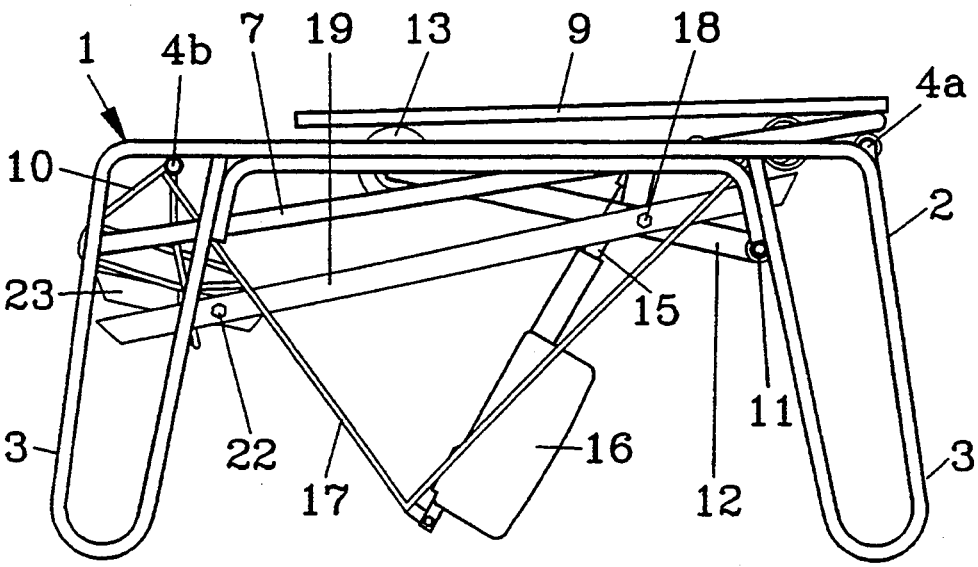
FIG. 2 is a side view of the chair stand in a partially erected position.
Figure 3:
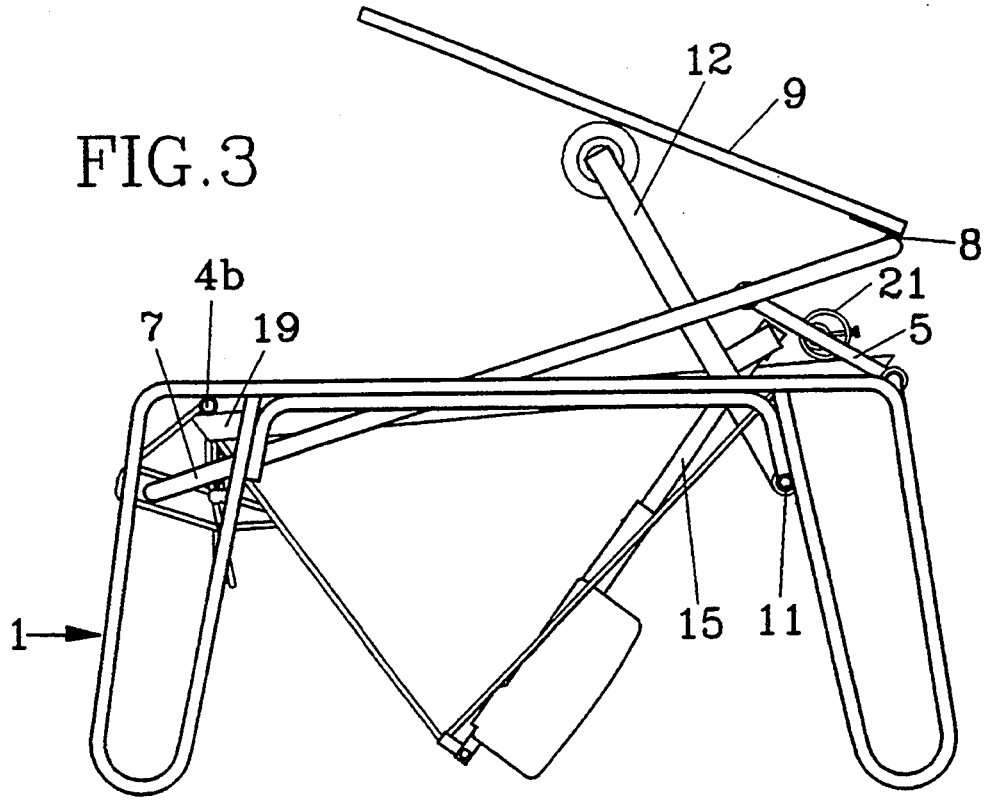
FIG. 3 is a view corresponding to FIG. 2 with a deviating setting of the adjustment means of the seat board.
Figure 4:
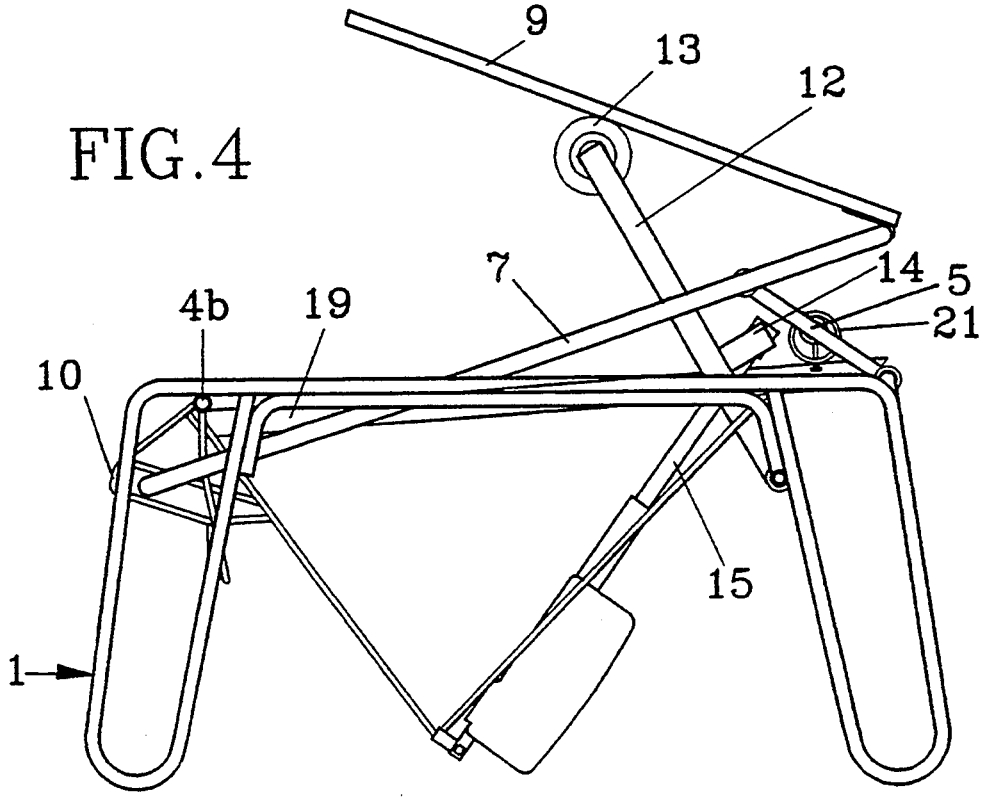
FIG. 4 is a view corresponding to FIG. 3 with a further different setting of the adjustment means.
Figure 5:
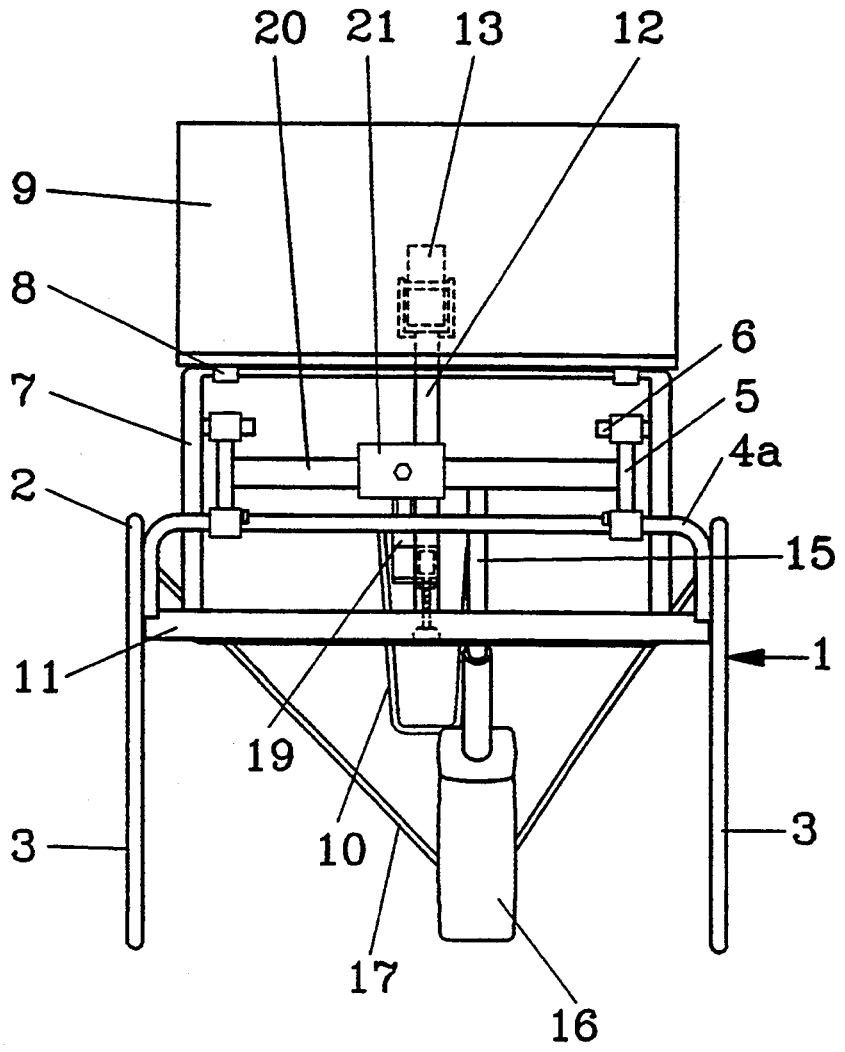
FIG. 5 is a front view of the setting position shown in FIG. 3.

The device shown in the figures includes a stand 1 in the shape of two tube frames 2, each in the form of a tube with the ends bent to equally long double folded legs 3. These tube frames 2 are mutually connected by means of a horizontal front cross bar 4*a* and a rear cross bar hinted at 4*b* whereby the stand 1 constitutes an essentially horizontal, rectangular frame supported by four legs 3. A pair of spaced apart guide arms 5 pivotally connected at one end to the front cross bar 4*a*. As shown in FIG. 5, the opposite ends of guide arms 5 are pivotally connected, such as by bearings, to shaft bars 6 secured to opposite side members of a rectangular member 7. A front edge of a seat board 9 is pivotally connected by horizontal hinges 8 to a front portion of the rectangular member 7 at the front end of the stand 1, see FIG. 2. The rectangular member 7 is inclined and extends from the front end of the stand 1 downwardly to the rear portion thereof. As shown in FIGS. 1 and 2, the rectangular member 7 has a rear end portion that is slidably supported by a slide rail 10 inclined upwardly toward the rear portion of the stand 1. On the front part of the stand 1, but behind the cross bar 4*a* a transverse axle 11 is mounted to frame 2 and centrally of which axle a pressure arm 12 is pivotally mounted, which pressure arm at its opposite end ends with a wheel 13 having an axis of rotation that is parallel to the axle 11, and which in operative position bears against the underside of the seat board 9 and is arranged to adjust the seat board into different oblique positions under pressure.

The pressure arm 12 for this purpose is equipped with an attachment bracket 14 perpendicular to the pressure arm which bracket is attached to the piston rod 15 of an electric actuator 16, which is pivotally suspended at its opposite end in a support structure 17 in the shape of cooperative rods, which are fastened to the stand and go together at a low point of attachment near the center of the stand, where the actuator is pivotally connected. The electric actuator 16 is naturally equipped with a power supply cable as well as cables (not shown in the figures) for controlling the actuator, which cables preferably are provided within an arm of the chair, in which the device shall be included, or to another appropriate position from an operational point of view. At the pressure arm 12 furthermore, at a position 18 in the proximity of the attachment bracket 14, a cantilever control bar 19 is pivotally connected, which bar extends in the longitudinal direction of the stand along the major part of the stand. This control bar 19 is arranged to be turned during the movement of the rod piston 15 and the tilt of the pressure arm 12 caused thereof, but its rotational movement upwards about its pivot point at portion 18 is limited at the front by a horisontally extending axle 20, arranged between the arms 5, with a backing roller 21 provided on said axle, which by means of a locking screw is lockable in different eccentric positions onto the axle whereby the front stop face of the control bar is settable. At the rear portion of the stand 1, upward movement of the control bar 19 is limited by the rear cross bar 4*b*. The control bar 19 is at its rear part furthermore equipped with a second arm portion 23, which is rotatably pivoted at point 22 on the control bar 19 and lockable in different tilting positions with respect to this point.

By means of the adjustability of the backing roller 21 and adjustability of the second arm portion 23 of the control bar 19, the movement path of the control bar can be adjusted after desiderata, to control the angle of elevation, to determine when the movement of the seatboard shall be transferred from a pure lifting movement to a combined lift-and tilting movement and even to adjust the sitting height of the chair, so that the height of the chair in a simple way can be adapted to different desiderata.

The function of the device according to the invention is described in the following: In FIG. 1 is shown a lateral view of the chair stand 1 in its sitting position, i.e. the seat board 9 is in a horizontal or a slightly inclined position. The front part of the chair stand in the figure is turned to the right while the side that supports the back is the left side in the figures. In this position the piston rod 15 of the actuator is maximally withdrawn.

When the actuator 16 now goes into operation its piston rod 15 moves out and thereby develops an upward directed force onto the attachment bracket 14 and thereby onto the pressure arm 12. At its motion, the control bar 19, which is pivoting about the axis 18 will at first with its front end move to stop against the backing roller 21. During this phase of the movement the wheel 13 of the pressure arm presses onto the seat board 9 so that this from its- slightly back leaned position pivotes to a horisontal or even slightly forward leaning position and simultaneously carrying the rectangular member 7 and the arms 5. When the control bar 19 is in contact with the backing roller 21, the rear part of the control bar respectively its other arm portion 23 will be lifted during simultaneous lift of the seat board 9 until the rear arm portion respectively the other arm portion 23 come in contact with the rear cross bar **4*b*** and in its further motion is prevented by this.

In this position, action from the pressure arm wheel 13, will only tilt the seat board 9 about the hinges 8 of the rectangular member 7 during further upward motion of the rod piston 15. When the seat board is maximally tilted up, it is in such a position, that a person sitting in the chair in a natural posture will be standing somewhat leaned backwards without thereby needing to execute bending and stretching movements with his knees and hips.

In a corresponding manner a person who is going to sit down, can lean himself slightly backwards against the chair seat and subsequently start the actuator 16 from the position where the seatboard is maximally folded up so that this will be reversed and in an inverted manner tilt down and lower the seat board to the sitting position.

In order to be able to adjust the chair height to suit persons with different height the backing roller 21 can be turned eccentric about its horizontal axis 20 and be locked in an optional position by means of its adjusting screw, and partly the other arm portion 23 of the control bar can be biased upwards in respect with the control bar 19 and likewise be locked in the desired position with its locking screw. Through such adjustment possibilities one can decide at which height and when in the motion path the front part of the control bar comes in contact with the backing roller 21 and thereby begins to exert a lifting force onto the rectangular member 7 and thereby associated parts and when the rear part of the control bars comes to bear against the rear cross bar **4*b*** and thereby prevents further lifting movement of the seat board.

The actuator 16 can of course be stopped in each desired position of motion so that the lift height and the tilt motion may be adapted to fit the individual's needs, and the movable parts can thus thereby be continuously stopped anywhere in its movement path.

The structural design and functions of the present invention provide a well functioning accessory for persons, who have difficulties in sitting down in a chair or armchair and who have difficulties in getting up from the same, and which furthermore is easily adjustable to adapt the movement pattern and the sitting height of the seat board after individual height and bodily constitution of each person.

The invention is not limited to the embodiment shown in the drawings and described in connection thereto, but modifications and variants are possible within the scope of the following claims.

We claim:

1. An adjustment device for a tiltable armchair comprising:

a stand having a front side and a rear side;

a front cross-bar attached to the stand adjacent the front side thereof;

a rear cross-bar attached to the stand adjacent the rear side thereof;

a rectangular member having a front portion, a rear portion and an intermediateportion disposed therebetween;

a seat board having a front edge that is pivotally connected to the front portion of the rectangular member, the seat board being movable between a substantially horizontal position and a tilted position;

a pair of guide arms each having one end pivotally connected to the intermediate portion of the rectangular member, the other end being pivotally connected to the front cross-bar;

a slide rail attached to the rear cross-bar, the rear portion of the rectangular member being slidably engaged with the slide rail so that movement of the rear portion is guided by the slide rail;

a driving device connected to the stand;

a pressure arm having a first end pivotally attached to the driving device and a Second end slidably engaged with the seat board so that the seat board is moved when the pressure arm is raised and lowered by the driving device;

an axle having its opposite ends secured to the guide arms;

a backing roller mounted on the axle;

a control bar having a front end and a rear end, the control bar being pivotally connected to the pressure arm intermediate the first and second ends of the pressure arm, the front end of the control bar engaging beneath the backing roller; and a rear part connected to the control bar adjacent the rear end of the control bar, the position of the rear part being adjustable relative to the position of the control bar so that when the pressure arm is raised by the driving device, the control bar is moved to engage the backing roller and the rear part is moved to engage the rear cross-bar.

2. A device according to claim 1, wherein the backing roller comprises a sleeve having the axle inserted therethrough, the sleeve having means for locking the axle into an eccentric position relative the sleeve.

3. A device according to claim 1, wherein the rear part is an arm portion having means for locking the position of the arm portion relative to the position of the control bar.

4. A device according to claim 1 wherein the driving device is an electric actuator comprising a piston rod pivotally connected to the pressure arm.

5. A device according to claim 2, wherein the rear part is an arm portion having means for locking the position of the arm portion relative to the position of the control bar.

6. A device according to claim 2, wherein the driving device is an electric actuator comprising a piston rod pivotally connected to the pressure arm.

7. A device according to claim 3, wherein the driving device is an electric actuator comprising a piston rod pivotally connected to the pressure arm.

* * * * *

UNITED STATES PATENT AND TRADEMARK OFFICE

CERTIFICATE OF CORRECTION

PATENT NO. : 5,372,404

DATED : December 13, 1994

INVENTOR(S) : Bratell et al.

It is certified that error appears in the above-indentified patent and that said Letters Patent is hereby corrected as shown below:

Column 2, line 31, "portion" should read --position--.

Column 4, line 7, "intermediateportion" should read --intermediate portion--.

Column 4, line 24, "Second" should read --second--.

Signed and Sealed this

Thirteenth Day of June, 1995

*Attest:*

Bruce Lehman

BRUCE LEHMAN

*Attesting Officer*

*Commissioner of Patents and Trademarks*